US005942484A

United States Patent [19]

Roetker et al.

[11] Patent Number: 5,942,484

[45] Date of Patent: Aug. 24, 1999

[54] PHASE-STABLE LIQUID FABRIC REFRESHMENT COMPOSITION

[75] Inventors: Timothy Clair Roetker, Fairfield; Ronald Anthony Masters, Loveland; Michael Peter Siklosi, Cincinnati, all of Ohio

[73] Assignee: The Procter & Gamble Company, Cincinnati, Ohio

[21] Appl. No.: 08/846,939

[22] Filed: Apr. 30, 1997

Related U.S. Application Data

[63] Continuation-in-part of application No. 08/544,235, Oct. 17, 1995, Pat. No. 5,630,847, which is a continuation-in-part of application No. 08/413,326, Mar. 30, 1995, abandoned

[60] Provisional application No. 60/018,392, May 29, 1996.

[51] Int. Cl.[6] ..... D06L 1/04

[52] U.S. Cl. ..... 510/426; 510/281; 510/284; 510/285; 510/289; 510/295; 510/424; 8/137; 8/142

[58] Field of Search ..... 510/281, 284, 510/285, 289, 295, 424, 426; 8/137, 142

[56] References Cited

U.S. PATENT DOCUMENTS

| | | | |
|---|---|---|---|
| 1,747,324 | 2/1930 | Savitt . | |
| 3,432,253 | 3/1969 | Dixon et al. | 8/142 |
| 3,591,510 | 7/1971 | Zenk | 252/137 |
| 3,593,544 | 7/1971 | Henderson | 68/12 |
| 3,633,538 | 1/1972 | Hoeflin | 118/76 |
| 3,647,354 | 3/1972 | Loeb | 8/158 |
| 3,737,387 | 6/1973 | Marple | 252/170 |
| 3,764,544 | 10/1973 | Haworth | 252/170 |
| 3,882,038 | 5/1975 | Clayton et al. | 252/164 |
| 3,907,496 | 9/1975 | Néel et al. | 8/142 |
| 3,949,137 | 4/1976 | Akrongold | 428/311 |
| 3,956,556 | 5/1976 | McQueary | 428/131 |
| 4,007,300 | 2/1977 | McQuaery | 427/242 |
| 4,013,575 | 3/1977 | Castrantas et al. | 252/104 |
| 4,097,397 | 6/1978 | Mizutani et al. | 252/153 |
| 4,102,824 | 7/1978 | Mizutani et al. | 252/545 |
| 4,115,061 | 9/1978 | Grünewälder | 8/137 |
| 4,126,563 | 11/1978 | Barker | 252/8.8 |
| 4,130,392 | 12/1978 | Diehl et al. | 8/101 |
| 4,139,475 | 2/1979 | Schwadtke et al. | 252/8.6 |
| 4,336,024 | 6/1982 | Denissenko et al. | 8/142 |
| 4,395,261 | 7/1983 | Lutz | 8/111 |
| 4,532,722 | 8/1985 | Sax | 34/60 |
| 4,594,362 | 6/1986 | Smith et al. | 521/52 |
| 4,606,842 | 8/1986 | Keyes et al. | 252/174.23 |
| 4,659,496 | 4/1987 | Klemm et al. | 252/90 |
| 4,692,277 | 9/1987 | Siklosi | 252/558 |
| 4,758,641 | 7/1988 | Hsu | 526/208 |
| 4,797,310 | 1/1989 | Barby et al. | 428/71 |
| 4,802,997 | 2/1989 | Fox et al. | 252/8.6 |
| 4,806,254 | 2/1989 | Church | 252/8.6 |
| 4,849,257 | 7/1989 | Borcher et al. | 427/242 |
| 4,886,615 | 12/1989 | Dehan | 252/90 |
| 4,909,962 | 3/1990 | Clark | 252/547 |
| 4,943,392 | 7/1990 | Hastedt et al. | 252/539 |
| 4,966,724 | 10/1990 | Culshaw et al. | 252/158 |
| 4,983,317 | 1/1991 | Requejo et al. | 252/174.24 |
| 5,004,557 | 4/1991 | Nagarajan et al. | 252/174.24 |
| 5,041,230 | 8/1991 | Borcher et al. | 252/8.9 |
| 5,062,973 | 11/1991 | Kellett | 252/8.75 |
| 5,080,822 | 1/1992 | VanEenam | 252/170 |
| 5,102,573 | 4/1992 | Han et al. | 252/153 |
| 5,112,358 | 5/1992 | Deal | 8/137 |
| 5,173,200 | 12/1992 | Kellett | 252/8.8 |
| 5,213,624 | 5/1993 | Williams | 134/40 |
| 5,238,587 | 8/1993 | Smith et al. | 252/8.6 |
| 5,547,476 | 8/1996 | Siklosi et al. | 8/142 |
| 5,591,236 | 1/1997 | Roetker | 8/137 |
| 5,630,847 | 5/1997 | Roetker | 8/137 |
| 5,630,848 | 5/1997 | Young et al. | 8/137 |
| 5,632,780 | 5/1997 | Siklosi | 8/137 |
| 5,681,355 | 10/1997 | Davis et al. | 510/281 |

FOREIGN PATENT DOCUMENTS

| | | | |
|---|---|---|---|
| 1005204 | 2/1977 | Canada | 8/93.11 |
| 0 213 500 | 3/1987 | European Pat. Off. | C11D 17/00 |
| 0 261 718 | 3/1988 | European Pat. Off. | C11D 17/00 |
| 429 172 A1 | 5/1991 | European Pat. Off. | D06F 43/00 |
| 1397475 | 6/1975 | United Kingdom | C11D 10/02 |
| 1598911 | 9/1981 | United Kingdom | D06F 43/00 |
| 2302553 | 1/1997 | United Kingdom | D06F 43/00 |
| 2302878 | 2/1997 | United Kingdom | C11D 1/83 |
| 2302879 | 2/1997 | United Kingdom | C11D 1/12 |
| WO 91/09104 | 6/1991 | WIPO | C11D 7/32 |
| WO 91/13145 | 9/1991 | WIPO | C11D 7/50 |
| WO 93/25654 | 12/1993 | WIPO | C11D 7/50 |
| WO 96/39556 | 12/1996 | WIPO | D06L 1/00 |
| WO 97/00990A2 | 1/1997 | WIPO . | |
| WO 97/00993A1 | 1/1997 | WIPO | D06L 1/02 |

OTHER PUBLICATIONS

Hunt, D.G. and N.H. Morris, "PnB and DPnB Glycol Ethers", *Happi,* Apr. 1989, pp. 78–82.

*Primary Examiner*—Jerry D. Johnson
*Attorney, Agent, or Firm*—Steven R. Chuey; Kim W. Zerby; Jacobus C. Rasser

[57] ABSTRACT

Phase stable liquid compositions comprise water, butoxy propoxy propanol and alkyl sulfate or alkyl ethoxy sulfate surfactants. The compositions are used to clean fabrics.

8 Claims, 1 Drawing Sheet

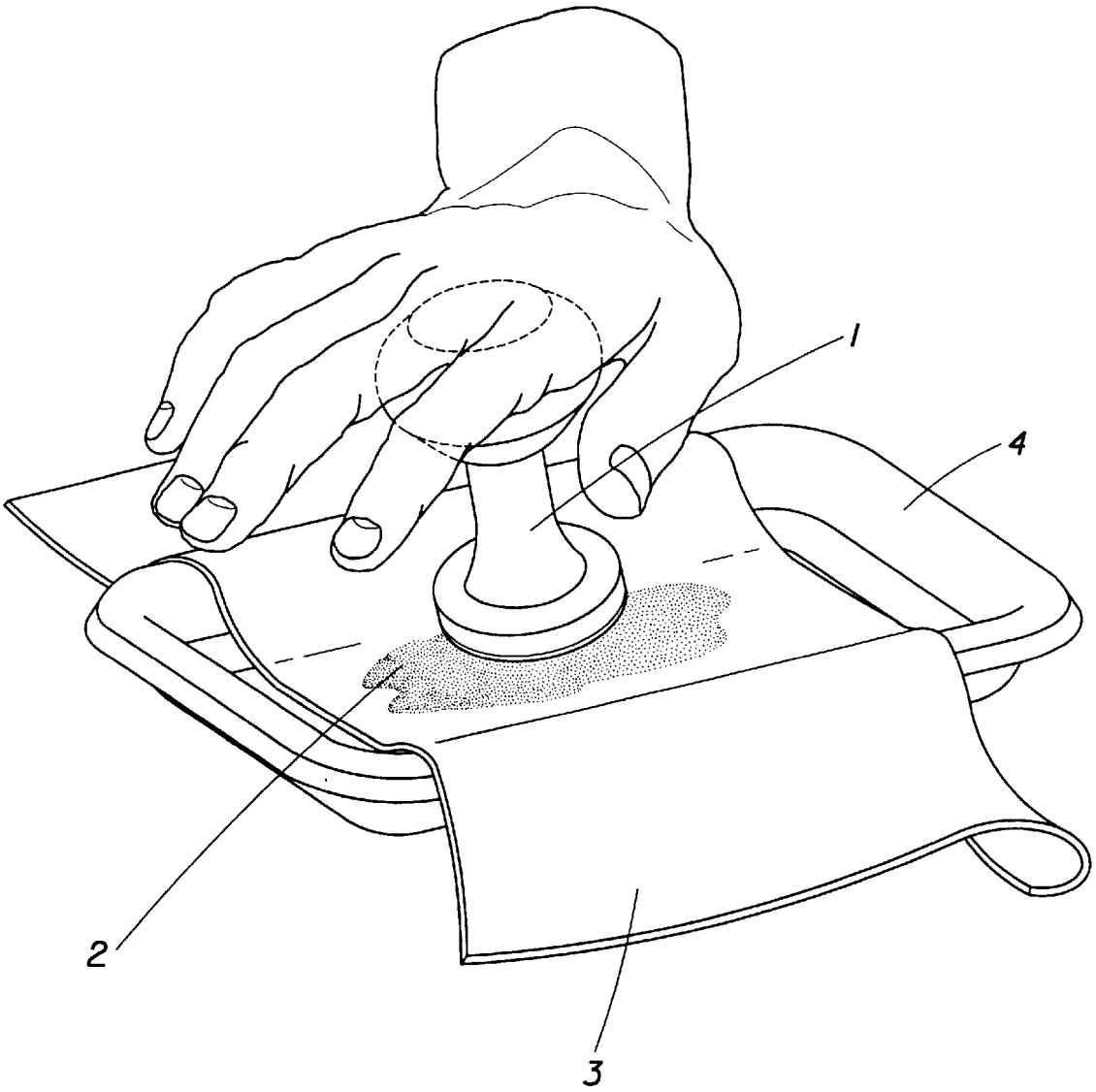
1
2
3
4

PHASE-STABLE LIQUID FABRIC REFRESHMENT COMPOSITION

CROSS REFERENCE

This application claims the benefit of U.S. Provisional application Ser. No. 60/018,392 filed May 29, 1996. this application is a continuation-in-part of U.S. application Ser. No. 08/544,235, filed Oct. 17, 1995, now U.S. Pat. No. 5,630,847, which is a continuation-in-part of U.S. application Ser. No. 08/413,326, filed Mar. 30, 1995, now abandoned.

FIELD OF THE INVENTION

The present invention relates to compositions for refreshing and/or cleaning fabrics.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

In addition to the cleaning function, dry cleaning also provides important "refreshment" benefits. For example, dry cleaning removes undesirable odors and extraneous matter such as hair and lint from garments, which are then generally folded or pressed to remove wrinkles and restore their original shape. Of course, such refreshment benefits are also afforded by aqueous laundering processes.

One type of home dry cleaning system comprises a carrier sheet containing various cleaning agents, and a plastic bag. The garments to be cleaned are placed in the bag together with the sheet, and then tumbled in a conventional clothes dryer. In a commercial embodiment, multiple single-use flat sheets and a single multi-use plastic bag are provided in a package. Unfortunately, such processes may not satisfactorily remove stains from heavily soiled or "spotted" areas of the fabrics being dry cleaned.

As is well known, soiled garments may be "pre-spotted" on localized areas using so-called "spot removal" compositions prior to cleaning or laundering. Butoxy propoxy propanol (BPP) is a preferred cleanings solvent for such use. It has now been discovered that liquid compositions comprising the preferred BPP solvent and water are unstable with respect to phase separation when stored at temperatures above about 90° F. Such elevated temperatures may be encountered when the compositions are stored or shipped and can result in an unacceptable product being delivered to the consumer.

By the present invention, it has been discovered that alkyl sulfate and/or alkyl ethoxy sulfate surfactants used as disclosed herein can be used to phase-stabilize such liquid compositions. Importantly, the stabilized compositions herein do not leave unsightly solid residues on the fabric being treated. These and other advantages are obtained by the present invention, as will be seen from the disclosures hereinafter.

BACKGROUND ART

Dry cleaning processes are disclosed in: EP 429,172A1, published 29.05.91, Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3,647,354; 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. Sheet substrates for use in a laundry dryer are disclosed in Canadian 1,005,204. U.S. Pat. No. 3,956,556 and 4,007,300 relate to perforated sheets for fabric conditioning in a clothes dryer. U.S. Pat. No. 4,692,277 discloses the use of 1,2-octanediol in liquid cleaners. See also U.S. Pat. Nos. 3,591,510; 3,737,387; 3,764,544; 3,882,038; 3,907,496; 4,097,397; 4,102,824; 4,336,024; 4,606,842; 4,758,641; 4,797,310; 4,802,997; 4,943,392; 4,966,724; 4,983,317; 5,004,557; 5,062,973; 5,080,822; 5,173,200; EP 0 213 500; EPO 261 718; G.B. 1,397,475; WO 91/09104; WO 91/13145; WO 93/25654 and Hunt, D. G. and N. H. Morris, "PnB and DPnB Glycol Ethers", *HAPPI* April 1989, pp. 78–82.

SUMMARY OF THE INVENTION

The present invention encompasses phase-stable, liquid fabric refreshment and cleaning compositions, comprising:

(a) a butoxy propoxy propanol or other alkoxylated alkoxy propanol solvent, typically up to about 6%, by weight, of the composition;

(b) water;

(c) optionally, a nonionic surfactant; and (d) an effective, phase stabilizing amount of a surfactant which is a member selected from the group consisting of alkyl sulfates, alkyl ethoxy sulfates and mixtures thereof.

The invention also encompasses a method for removing both localized and overall stains and soils from fabrics and refreshing fabrics by contacting said fabrics with the above-disclosed compositions.

The localized spot removal (a.k.a. "pre-spotting") step of the present invention is preferably conducted using a treatment means comprising a spot removal device, especially a device designed for hand-held use, comprising:

(a) a base member having a convex front treatment face and a rear face oppositely disposed from said treatment face;

(b) one or more treatment members extending outwardly from said treatment face; and (c) optionally, a hand grip affixed to said rear face.

A preferred device herein is wherein the front treatment face is substantially hemispherical, or alternatively, inscribes a section of a hemisphere.

In one embodiment of the device, the face has a treatment member which comprises an absorbent material such as a sponge, a pad, or the like. In another embodiment, the treatment member comprises a multiplicity of protrusions, such as bristles. In yet another embodiment of the device, the treatment member comprises a sponge base having a multiplicity of protrusions extending outwardly therefrom.

In other less preferred embodiments, the treatment means need not be part of the device as noted, but can be simple pads, sheets (e.g., disposable paper toweling), cloth wipes, sponges, or the like, which can be pressed against the stained area of the fabric.

The invention also encompasses a method for removing stains from a stained area of fabrics, comprising the steps of:

(a) applying an aqueous cleaning composition of the present type to said stained area;

(b) concurrently or consecutively with Step (a), contacting the stained area of the fabrics with treatment means, preferably using a convex device as noted above; and (c) applying compressive force to the device, especially using a rocking or rolling motion imparted to the device.

Reference is made to the FIGURE. In this mode, the pre-spotting process is shown being conducted using a carrier sheet which is saturated with the cleaning composition and positioned in a holding tray or other suitable receptacle as a containment system for the cleaning composition. This allows the mechanical agitation afforded by the device to take place in an environment saturated or partially saturated with cleaning composition, akin to a "micro" washing machine.

It is to be understood, however, that, in the pre-spotting step of the process herein, the cleaning compositions can be applied to the fabric by any convenient means, e.g., by spraying, daubing, pouring, and the like, rather than from a carrier sheet. This mode can also conveniently be conducted using a tray or other receptacle according to the following general procedure:

1. Place the stained area of the fabric over an ordinary folded paper towel (e.g., BOUNTY® brand) and tray (paper towel is sitting in the tray).
2. Apply enough cleaning composition from a bottle with a narrow spout which directs the cleaning composition onto the stain (without unnecessarily saturating the surrounding area of the fabric) to saturate the localized stained area—about 10 drops; more may be used for a larger stain.
3. Let the solution penetrate the stain for 3–5 minutes. (This is a pre-treat or pre-hydration step for better cleaning results.)
4. Apply additional cleaning composition—about 10 drops; more may be used for larger stains.
5. Use the spot removal device to work stain completely out. Rock the device firmly for at least 2 minutes, longer for tougher stains. Do not rub the stain with the device.
6. Blot garment between paper towels to remove excess cleaning composition. This helps considerably to minimize residue rings.
7. Conduct the in-dryer cleaning/refreshment process disclosed herein on the entire fabric.

The key benefits in conducting the pre-spotting process in this way are that the pre-hydration step makes cleaning easier (rather like soaking a casserole dish in hot water with dishwashing detergent before trying to clean it), and minimizes ring formation on the fabric.

The invention also encompasses an overall dry cleaning process for treating an entire area of fabric surface, which comprises a prespotting operation according to this invention and comprising the overall steps of:

(i) conducting a stain removal process according to the above disclosure on localized stained areas of fabric;

(ii) placing the entire fabric from step (i) together with a carrier containing the aqueous fabric refreshment/cleaning composition in a containment bag which is preferably vapor-permeable;

(iii) placing the bag in a device to provide agitation, e.g., such as in a hot air clothes dryer and operating the dryer with heat and tumbling; and (iv) removing the fabric from the bag.

While, as noted, the process herein is particularly useful in a stain removal step of a dry cleaning process, it can also be used in a stand-alone stain removal process, or as a stain removal process associated with an otherwise conventional laundering process. Thus, the invention also encompasses an overall laundering process for fabrics which comprises a prespotting operation according to this invention and comprising the overall steps of:

(i) conducting a stain removal process according to the above disclosure on localized stained areas of the fabric; and (ii) laundering the entire fabric from step (i) in a conventional aqueous laundering process.

The invention also encompasses a dry cleaning kit, comprising:

(a) an aqueous fabric refreshment and cleaning composition which is, optionally, releasably contained on a carrier substrate;

(b) a re-usable containment bag;

(c) optionally, a fabric cleaning device, as disclosed herein, (d) optionally, a re-usable holding tray; and (e) optionally, a non-aqueous cleaning composition.

All percentages, ratios and proportions herein are by weight, unless otherwise specified. All documents cited are, in relevant part, incorporated herein by reference.

BRIEF DESCRIPTION OF THE DRAWINGS

The FIGURE is a perspective of the present process using a convex device (1) to spot treat stains (2) using hand pressure. In this procedure, a holding tray (4) is placed beneath the fabric (3) being treated and a sheet substrate releasably containing a cleaning composition is placed in the tray. The fabric being treated is then placed over the sheet substrate and the device is rocked back and forth on the stained area. A portion of the cleaning composition is released from the sheet substrate into and through the stained area of the fabric. The treatment members on the treatment face of the device gently, but effectively, work in combination with the cleaning composition to loosen and remove the stain from the fabric.

DETAILED DESCRIPTION OF THE INVENTION

The components of the compositions, processes and devices of this invention and their method of use are described in more detail hereinafter. Such disclosure is by way of illustration and not limitation of the invention herein.

By "phase-stable" herein is meant liquid compositions which are homogeneous over their intended usage range (ca. 50° F.–95° F.), or which, if stored temperatures which cause phase separation (~40° F.–110° F.), will revert to their homogeneous state when brought back to temperatures in the intended usage range.

By an "effective amount" herein is meant an amount of the alkyl sulfate and/or alkyl ethoxy sulfate surfactant sufficient to provide a phase-stable liquid composition, as defined hereinabove.

By "aqueous" cleaning compositions herein is meant compositions which comprise a major portion of water, plus the BPP or other cleaning solvents, the aforesaid surfactant or surfactant mixture, optional other surfactants, especially amine oxides, hydrotropes, perfumes, and the like, especially those disclosed hereinafter.

By "cleaning" herein is meant the removal of soils and stains from fabrics. By "refreshment" herein is meant the removal of malodors and/or wrinkles from the fabrics, or the improvement of their overall appearance, other than primarily removing soils and stains. Typical fabric refreshment compositions can comprise more water (95–99.9%, preferably greater than 95% up to about 99%) and fewer cleaning ingredients than typical cleaning compositions.

By "protuberances" herein is meant knobs, fibers, bristles or like structures which extend outwardly from the surface of the treatment device. Such elements of the device come into contact with the fabric being spot-cleaned ("prespotted") to provide the mechanical cleaning action.

By "contact with stained areas" is meant contact which is afforded by impingement of the protuberances, pads, sponges, etc., which comprise the treatment means or device with the stained area. It is highly desirable that this contact result in a force which is directed substantially downward, i.e., in the Z-direction substantially perpendicular to the surface of the stain, rather than a side-to-side scrubbing motion in the X- and Y-directions, to minimize fabric damage or "wear". Preferably, the contact is associated with a rocking or rolling motion by the device, whereby the curved surface of the device imparts the force in the Z-direction.

Alkyl Sulfates, Alkyl Ethoxy Sulfates and Optional Surfactants—The alkyl sulfate surfactants used herein are the $C_8$–$C_{18}$ primary ("AS"; preferred $C_{10}$–$C_{14}$, sodium salts), as well as branched-chain and random $C_{10}$–$C_{20}$ alkyl sulfates, and $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$–$C_{16}$ alkyl, EO is —$CH_2CH_2$—O—, x is 1–10 and can include mixtures which are conventionally reported as averages, e.g., $(EO)_{2.5}$, $(EO)_{6.5}$ and the like, and Z is a cation such as sodium and, preferably, magnesium (MgAES). The $C_{12}$–$C_{16}$ dimethyl amine oxide surfactants can also be used. A preferred mixture comprises $MgAE_1S/MgAE_{6.5}S/C_{12}$ dimethyl amine oxide at a weight ratio of about 1:1:1. Other surfactants which improve phase stability and which optionally can be used herein include the polyhydroxy fatty acid amides, e.g., $C_{12}$–$C_{14}$ N-methyl glucamide. Nonionics such as the ethoxylated $C_{10}$–$C_{16}$ alcohols, e.g., NEODOL 23–6.5, which do not negatively impact phase stability can also be included in the overall compositions. AS stabilized compositions preferably comprise 0.1%–0.5%, by weight, of the compositions herein. MgAES and amine oxides, if used, can comprise 0.01%–2%, by weight, of the compositions. The optional surfactants can be used at similar levels.

Compositions—The chemical compositions which are used to provide the cleaning and refreshment functions in the present device and process comprise ingredients which are safe and effective for their intended use. Since the process herein does not involve an aqueous rinse step, the compositions employ ingredients which do not leave undesirable residues on fabrics when employed in the manner disclosed herein. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like.

In addition, the compositions herein comprise ingredients which are specially selected and formulated to minimize dye removal or migration from the stain site of fugitive, unfixed dye from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred compositions herein are formulated to minimize or avoid this problem.

The dye removal attributes of the present compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or rayon fabrics) is treated by padding-on cleaner/refresher using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) "I see a lot of dye on the towel"; through (4) "I know I see quite a lot of dye on the towel" are assigned by panelists.

In addition to the foregoing considerations, the compositions used herein are preferably formulated such that they are easily dispensed and not so adhesive in nature that they render the spot-cleaning device unhandy or difficult to use. However, and while not intending to be limiting of the present invention, the preferred compositions disclosed herein afford a spot-cleaning process which is both effective and aesthetically pleasing when used with a device according to this invention.

Having due regard to the foregoing considerations, the following illustrates the ingredients used in the dry cleaning compositions herein, but is not intended to be limiting thereof Aqueous Compositions (a) Solvent—The compositions herein will preferably comprise from about 0.5% to about 4%, by weight, of BPP solvent.

(b) Water—The compositions herein will comprise from about 94%, preferably from about 95.5% to about 99%, by weight, of water.

(c) Stabilized Surfactant—The preferred compositions herein will comprise from about 0.05% to about 2%, by weight, of alkyl sulfate or MgAES surfactants. Typically, the weight ratio of BPP solvent:surfactant(s) is in the range of from about 10:1 to about 1:1. A preferred composition comprises 4% BPP/0.4% AS.

(d) Optionals—The cleaning compositions herein may comprise minor amounts of various optional ingredients, including perfumes, conventional surfactants, and the like. If used, such optional ingredients will typically comprise from about 0.05% to about 2%, by weight, of the compositions, having due regard for residues on the cleaned fabrics.

Organic Solvent—The preferred cleaning solvent herein is butoxy propoxy propanol (BPP) which is available in commercial quantities as a mixture of isomers in about equal amounts. The isomers, and mixtures thereof, are useful herein. The isomer structures are as follows:

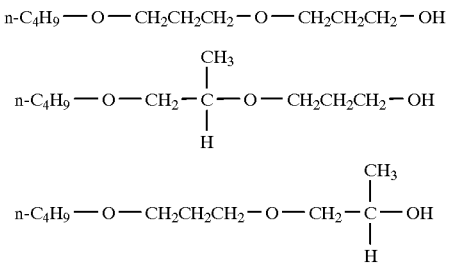

While the cleaning compositions herein function quite well with only the BPP, water and stabilizing surfactant, they may also optionally contain other ingredients to further enhance their stability. Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein.

Other Optionals—In addition to the water, the preferred BPP solvent and the AS surfactant solvent disclosed above, the cleaning compositions herein may comprise various optional ingredients, such as perfumes, preservatives, brighteners, salts for viscosity control, pH adjusters or buffers, and the like. The following illustrates preferred ranges for cleaning compositions for use herein, but is not intended to be limiting thereof.

| Ingredient | % (wt.) Formula Range |
|---|---|
| BPP | 0.05–5 |
| AS | 0.05–2 |
| Perfume | 0.01–1.5 |
| Water | Balance |

pH range from about 6 to about 8.

Other cleaning solvents or co-solvents which can optionally be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and BPP, as well as butoxy propanol (BP), and the like, and mixtures thereof. If used, such co-solvents will typically comprise from about 0.5% to about 2.5%, by weight, of the compositions herein.

In its fabric refreshment aspect, the use of the compositions herein is based on the discovery that the presence of low molecular weight organic solvents used in a containment bag can actually inhibit the ability to remove malodors from garments with an in-dryer product as a dry cleaning alternative. In this aspect of the invention, the garments are placed in a carrier bag of reasonable gas permeability or porosity along with a carrier sheet (preferably non-woven fabric) wetted with about 10 to about 100 g of a water-based composition of the present type. Water vapor fills the bag as it is tumbled in a heated dryer, and this vapor leaves the bag, apparently carrying with it the malodor components which are also heat-volatilized. Moistening of garments by sheet contact and condensing vapors also appears to enhance odor improvement and wrinkle removal. This contact can occur during the tumbling in the dryer or through direct contact moistening of fabric by the wetted sheet prior to inclusion in the bag. In this manner, dry-clean type fine garments can be refreshed and made wearable again by treatment in a bag in a heated dryer. Cigarette smoke can be removed to trace or non-detectable levels without any perfume cover in only about an hour. Body odors can be mostly removed, with the less volatile residues easily covered using low perfume levels on the carrier sheet. Volatile and non-volatile stains and malodors can be concentrated on the carrier as a scavenger, which is then discarded.

Preferred refreshment compositions herein are as follows.

| Ingredient | % (wt.) | Range (% wt.) |
|---|---|---|
| Water | 99.0 | 95.1–99.99 |
| Perfume | 0.5 | 0.05–1.5 |
| Surfactant* | 0.5 | 0.05–2.0 |
| Ethanol or Isopropanol | 0 | Optional to 4% |

*Especially ethoxylated alcohols, as disclosed herein. The fabric refreshment compositions may also contain anionic surfactants. Such anionic surfactants are well-known in the detergency arts. Commercial surfactants available as TWEEN ®, SPAN ®, AEROSOL OT ® and various sulfosuccinic esters are especially useful herein.

Carrier—When used in a dry cleaning operation of the present type, the foregoing cleaning and/or refreshment compositions are conveniently used in combination with a carrier, such that the compositions perform their function as the surfaces of the fabrics come in contact with the surface of the carrier. The carrier releasably contains the compositions. By "releasably contains" means that the compositions are effectively released from the carrier onto the soiled fabrics as part of the spot removal, dry cleaning and/or fabric refreshment processes herein.

The carrier can be in any desired form, such as powders, flakes, shreds, and the like. However, it will be appreciated that such comminuted carriers would have to be separated from the fabrics at the end of the process. Accordingly, it is highly preferred that the carrier be in the form of an integral pad or sheet which substantially maintains its structural integrity throughout the process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present process. The carriers must not be flammable during the process, nor should they deleteriously interact with the cleaning or refreshment composition or with the fabrics being cleaned. In general, non-woven polyester-based pads or sheets are quite suitable for use as the carrier herein.

The carrier used herein is most preferably non-linting. By "non-linting" herein is meant a carrier which resists the shedding of visible fibers or microfibers onto the fabrics being cleaned, i.e., the deposition of what is known in common parlance as "lint". A carrier can easily and adequately be judged for its acceptability with respect to its non-linting qualities by rubbing it on a piece of dark blue woolen cloth and visually inspecting the cloth for lint residues.

The non-linting qualities of sheet or pad carriers used herein can be achieved by several means, including but not limited to: preparing the carrier from a single strand of fiber; employing known bonding techniques commonly used with nonwoven materials, e.g., point bonding, print bonding, adhesive/resin saturation bonding, adhesive/resin spray bonding, stitch bonding and bonding with binder fibers. In an alternate mode, a carrier can be prepared using an absorbent core, said core being made from a material which, itself, sheds lint. The core is then enveloped within a sheet of porous, non-linting material having a pore size which allows passage of the cleaning or refreshment compositions, but through which lint from the core cannot pass. An example of such a carrier comprises a cellulose or polyester fiber core enveloped in a non-woven polyester scrim.

The carrier should be of a size which provides sufficient surface area that effective contact between the surface of the carrier and the surface of the fabrics being treated is achieved. Of course, the size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a rectangular carrier may have the dimensions (X-direction) of from about 20 cm to about 35 cm, and (Y-direction) of from about 18 cm to about 45 cm. Two or more smaller carrier units can be used when a larger surface area is desired (or needed).

The carrier is intended to contain a sufficient amount of the cleaning or refreshment compositions to be effective for their intended purpose. The capacity of the carrier for such compositions will vary according to the intended usage. For example, pads or sheets which are intended for a single use will require less capacity than such pads or sheets which are intended for multiple uses. For a given type of carrier the capacity for the cleaning or refreshment composition will vary mainly with the thickness or "caliper" (Z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 mm. Of course, the foregoing dimensions may vary, as long as the desired quantity of the cleaning or refreshment composition is effectively provided by means of the carrier.

A preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244. The manufacture of such materials forms no part of this invention and is already disclosed in the literature. See, for example, U.S. Pat. Nos. 5,009,747, Viazmensky, et al., Apr. 23, 1991 and 5,292,581, Viazmensky, et al., Mar. 8, 1994, incorporated herein by reference. Preferred materials for use herein have the following physical properties.

| | Grade 10244 | Targets | Optional Range |
|---|---|---|---|
| Basis Weight | $gm/m^2$ | 55 | 35–75 |
| Thickness | microns | 355 | 100–1500 |
| Density | gm/cc | 0.155 | 0.1–0.25 |
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 ($H_2O$) |
| Dry Mullen | $gm/cm^2$ | 1050 | 700–1200 |

*MD - machine direction; CD - cross direction

As disclosed in U.S. Pat. No. 5,009,747 and 5,292,281, the hydroentangling process provides a nonwoven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning and/or refreshment compositions herein, but actually optimizes cleaning performance. While not intending to be limited by theory, it may be speculated that this carrier is more effective in delivering the compositions to soiled fabrics. Or, this particular carrier might be better for removing soils by contact with the soiled fabrics, due to its mixture of fibers. Whatever the reason, improved dry cleaning performance is secured.

In addition to the improved performance, it has now been discovered that this hydroentangled carrier material provides an additional, unexpected benefit due to its resiliency. In-use, the sheets herein are designed to function in a substantially open configuration. However, the sheets may be packaged and sold to the consumer in a folded configuration. It has been discovered that carrier sheets made from conventional materials tend to undesirably revert to their folded configuration in-use. This undesirable attribute can be overcome by perforating such sheet, but this requires an additional processing step. It has now been discovered that the hydroentangled materials used to form the carrier sheet herein do not tend to re-fold during use, and thus do not require such perforations (although, of course, perforations may be used, if desired). Accordingly, this attribute of the hydroentangled carrier materials herein makes them optimal for use in the manner of the present invention.

Controlled Release Carriers—Other carriers which can be used in the present invention are characterized by their ability to absorb liquid cleaning compositions, and to release them in a controlled manner. Such carriers can be single-layered or multi-layer laminates. In one embodiment, such controlled-release carriers can comprise the absorbent core materials disclosed in U.S. Pat. No. 5,009,653, issued Apr. 23, 1991, to T. W. Osborn II, entitled "Thin, Flexible Sanitary Napkin", assigned to The Procter & Gamble Company, incorporated herein by reference. Another specific example of a controlled-release carrier herein comprises a hydroentangled web of fibers (as disclosed above) having particles of polymeric gelling materials dispersed, either uniformly or non-uniformly, in the web. Suitable gelling materials include those disclosed in detail at columns 5 and 6 of Osborn, as well as those disclosed in U.S. Pat. No. 4,654,039, issued Mar. 31, 1987, to Brandt, Goldman and Inglin. Other carriers useful herein include WATER-LOCK® L-535, available from the Grain Processing Corporation of Muscatin, Iowa. Non-particulate superabsorbents such as the acrylate fibrous material available under the tradename LANSEAL F from the Choli Company of Higashi, Osaka Japan and the carboxymethylcellulose fibrous material available under the tradename AQUALON C from Hercules, Inc., of Wilmington, Del. can also be used herein. These fibrous superabsorbents are also convenient for use in a hydro-entangled-type web.

In another embodiment the controlled release carrier can comprise absorbent batts of cellulosic fibers or multiple layers of hydroentangled fibers, such as the HYDRASPUN sheets noted above. In this embodiment, usually 2 to about 5 sheets of HYDRASPUN, which can optionally be spot-bonded or spot-glued to provide a coherent multi-layered structure, provides an absorbent carrier for use herein without the need for absorbent gelling materials, although such gelling materials can be used, if desired. Other useful controlled release carriers include natural or synthetic sponges, especially open-cell polyurethane sponges and/or foams. Whatever controlled release carrier is selected, it should be one which imbibes the liquid cleaning compositions herein thoroughly, yet releases them with the application of pressure or heat. Typically, the controlled release carriers herein will feel wet or, preferably, somewhat damp-to-nearly dry to the touch, and will not be dripping wet when carrying 10–30 g. of the cleaning composition.

Coversheet—In an optional embodiment, a liquid permeable coversheet is superimposed over the carrier. In one embodiment, the coversheet is associated with the carrier by spray-gluing the coversheet to the surface of the carrier. The coversheet is preferably a material which is compliant and soft feeling. Further, the coversheet is liquid and/or vapor pervious, permitting the cleaning composition to transfer through its thickness. A suitable coversheet may be manufactured from a wide range of materials such as polymeric materials, formed thermoplastic films, apertured plastic films, porous films, reticulated foams, natural fibers (e.g., wood or cotton fibers), woven and non-woven synthetic fibers (e.g., polyester or polypropylene fibers) or from a combination of natural and synthetic fibers, with apertured formed films being preferred. Apertured formed films are preferred for the coversheet because they are pervious to the liquid cleaning and/or refreshment compositions (or vapors) and yet non-absorbent. Thus, the surface of the formed film which is in contact with the fabrics remains relatively dry, thereby further reducing water spotting and dye transfer. Suitable formed films are described in U.S. Pat. No. 3,929,135, entitled "Absorptive Structure Having Tapered Capillaries", issued to Thompson on Dec. 30, 1975; U.S. Pat. No. 4,324,246, entitled "Disposable Absorbent Article Having A Stain Resistant Coversheet", issued to Mullane and Smith on Apr. 13, 1982; U.S. Pat. No. 4,342,314, entitled "Resilient Plastic Web Exhibiting Fiber-Like Properties", issued to Radel and Thompson on Aug. 3, 1982; and U.S. Pat. No. 4,463,045, entitled "Macroscopically Expanded Three-Dimensional Plastic Web Exhibiting Non-Glossy Visible Surface and Cloth-Like Tactile Impression", issued to Ahr, Louis, Mullane and Ouellete on Jul. 31, 1984, all of which are incorporated herein by reference.

In a preferred embodiment of the present invention, the outer and/or inner surfaces of the coversheet are hydrophilic. The surfaces of the coversheet can be made hydrophilic by treatment with a surfactant which is substantially evenly and completely distributed throughout the surface of the coversheet. This can be accomplished by any of the common techniques well known to those skilled in the art. For example, the surfactant can be applied to the coversheet by spraying, by padding, or by the use of transfer rolls. Further, the surfactant can be incorporated into the polymeric materials of a formed film coversheet. Such methods are disclosed in U.S. Pat. No. 5,009,653, cited above.

Spot Removal Devices—The devices which are optionally, but preferably, used in the pre-spotting operation herein can be manufactured by injection molding using polymers such as low- and high-density polyethylene, polypropylene, nylon-6, nylon-6,6, acrylics, acetals, polystyrene, polyvinyl chloride, and the like. High density polyethylene and polypropylene are within this range and are preferred for use herein.

The treatment members on the devices herein can comprise natural or synthetic bristles, natural or synthetic sponges, absorbent pads such as cotton, rayon, regenerated cellulose, and the like, as well as the HYDRASPUN® fabric described hereinabove. Various useful materials are all well-known in the cleaning arts in conventional brushes and toothbrushes (see U.S. Pat. No. 4,637,660) and in various cleaning utensils. Sponges, pads, and the like will typically have a thickness of from about 1 mm to about 1.25 cm and can be glued to the convex front treatment face of the device. Preferably, the sponges, pads, bristled pads, etc., are typically co-extensive with substantially the entire treatment face.

The protuberances herein can be in the form of blunt or rounded bristles, which may be provided uniformly across the entire treatment face or in clusters. The protuberances can be in the form of monofilament loops, which can be circular, ovoid or elongated, or can be cut loops. The protuberances can comprise twisted fiber bundles, extruded nubs, molded finger-like appendages, animal hair, reticulated foams, rugosities molded into the face of the member, and the like. Protuberances made from monofilament fibers may be straight, twisted or kinked.

In one embodiment, the treatment member can comprise multiple components. In particular, the treatment member can comprise an absorbent base material which can be, for example, a natural or synthetic sponge, an absorbent cellulosic sheet or pad, or the like. In contact with and extending outward from this base material are multiple protrusions as disclosed above. A specific example of this embodiment is a treatment member comprising multiple looped protuberances made from monofilament fibers which protrude from a sponge base layer. In this embodiment, the absorbent base layer acts as a reservoir which feeds cleaning composition to the protuberances.

In various optional modes, the treatment members present on the convex face of the device herein can comprise a multi-layer composite comprising a sponge-like, resilient backing material for a fibrous layer having multiple fibrous elements extending outwardly therefrom. Such composites can be permanently or semi-permanently affixed to the treatment members using glue or other conventional means, and, typically, are substantially co-extensive with the face of the treatment member. Such composites can be made from conventional materials, e.g., using a sponge, foam or other absorbent base pad material from about 0.5–20 mm thickness and a layer of fibers such as a conventional painter's pad with fibers having a length of from about 0.05 mm to about 20 mm.

The protuberances herein are typically provided as a bed or mat which comprises multiple strands or loops which extend therefrom in the Z-direction. Convenient and familiar sources include pile carpet-type materials, paint pad-type materials, and the like. In such embodiments, the treatment member will comprise several thousand protuberances per $cm^2$. With the preferred looped protuberances herein, there will typically be 10–500, preferably about 60–150, loops per $cm^2$. The choice of the source, style and number of protuberances are matters for the manufacturer's discretion, and the foregoing illustrations are not intended to be limiting of the invention.

The protuberances should preferably extend outwardly from the face of the treatment member for a distance of at least about 0.2 mm. While there is no upper limit to their length, there is essentially no functional reason for the protuberances to extend more than about 1.25 cm.

The protuberances can be made from plastic, rubber or any other convenient, resilient material which is stable in the presence of the cleaning composition. Fibrous protrusions can be made from natural or synthetic fibers. Fiber diameters can typically range from 0.1 mil (0.0025 mm) to 20 mil (0.5 mm). Again, this is a matter of selection and is not intended to be limiting.

In one embodiment, the protuberances are in the form of a multiplicity of stiffened, ovoid looped fibers which extend outwardly from the treatment face. Such looped fibers can comprise, for example, 7 mil (0.18 mm) monofilament loops of polypropylene extending at least about 0.03 inch (0.76 mm), typically from about 2.0 mm to about 1.5 cm, outwardly from the face of a backing material. The diameter of the loops at their widest point is about 1.3 mm. A convenient material for said looped protrusions is available commercially from APLIX Inc., Number 200, Unshaved Loop, Part No. DM32M000-QY. This material comprises a nylon backing with about 420 loops per square inch (65 loops per $cm^2$) extending from its surface.

It will be appreciated that the devices herein can be made from a variety of plastic, glass, wood, etc. materials and with various overall shapes, decorations and the like, according to the desires of the manufacturer. Of course, the devices are preferably made from materials which will not be affected by the various ingredients used in the cleaning compositions. The size of the devices is entirely optional. It is contemplated that rather large devices (e.g. 200–1000 $cm^2$ convex treatment face) would be suitable for mounting and use in a commercial cleaning establishment. For in-home use, the device is intended for hand-held use, and its dimensions are generally somewhat smaller; typically, the surface area of the convex treatment face for home use will be in the range of from about 10 $cm^2$ to about 200 $cm^2$. While the convex treatment faces illustrated herein are, mainly, sections of spheres, the convex face of the device can also be in the manner of a desk-style ink blotter. Stated otherwise, the front treatment face of the device can be outwardly curved over its operational plane, but flat along its sides.

While the surface area of the treatment members can be adjusted according to the desires of the manufacturer, it is convenient for a hand-held, home-use device to have a treatment face whose surface area is in the range from about 25 $cm^2$ to about 70 $cm^2$.

Containment Bag—The construction of the preferred, heat-resistant flexible bag used herein to contain the fabrics in a hot air laundry dryer or similar device preferably employs thermal resistant films to provide the needed temperature resistance to internal self-sealing and external surface deformation sometimes caused by overheated clothes dryers. In addition, the bags are resistant to the chemical agents used in the cleaning or refreshment compositions herein. By proper selection of bag material, unacceptable results such as bag melting, melted holes in bags, and sealing of bag wall-to-wall are avoided. In a preferred mode, the closure means for the bag is also constructed of a thermal resistant material. In one mode, the bags can be substantially impermeable to water vapor and to the vapors from the cleaning and/or refreshment compositions. In a preferred mode (disclosed hereinafter) the bags are designed to release such vapors.

The dimensions of the containment bag can vary, depending on the intended end-use. For example, a bag can be provided which is sufficient to contain one or two silk blouses. Alternatively, a bag suitable for handling a man's suit can be provided. Typically, the bags herein will have an internal volume of from about 10,000 $cm^3$ to about 25,000 $cm^3$. Bags in this size range are sufficient to accommodate a reasonable load of fabrics (e.g., 1–5 kg) without being so large as to block dryer vents.

The bag herein is preferably flexible, yet is preferably durable enough to withstand multiple uses. Typically, such bags are prepared from 0.025 mm to 0.075 mm (1–3 mil) thickness polymer sheets. If some rigidity in the bag is desired, somewhat thicker sheets can be used.

In a preferred embodiment, a 1–3 mil nylon film is sealed into a 26 inch (66 cm)×30 in. (76 cm) bag. Sealing is preferably done using standard impulse heating equipment. In an alternate mode, a sheet of nylon is simply folded in half and sealed along two of its edges. In yet another mode, bags can be made by air blowing operations.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400°–500° F. (204° C. to 260° C.). Under circumstances where excessive heating is not of concern, the bag can be made of polyester, polypropylene or any convenient polymer material.

The preferred bag herein is designed to vent water vapor during the dryer stage of the present process. In order to achieve this, the walls of bags which are made from polymer sheet stock can be provided with slits, holes (preferred) or the like to provide means for the venting to occur. This can be simply, yet effectively, achieved by punching holes in the walls of the bag using any convenient instrument. In a typical mode, 6–15 pairs of 0.2 cm–0.6 cm holes are uniformly punched in the walls of a substantially rectangular bag having a total volume of about 25,000 $cm^3$. This provides adequate venting in the process herein. In another mode, a series of longitudinal slits are cut in the walls of the bag. In yet another mode, the mouth of the bag is designed to be only partially closed during use.

In an alternate embodiment, venting can be achieved by using containment bags which are constructed from woven or non-woven fabrics, rather than from sheet-form polymers. This allows the vapors to penetrate directly from the bag through the pores and void spaces which are inherently present in the walls of the bag. Thus, bags made from nylon, polyester, cotton, rayon, and the like, fibers using conventional weaving processes or processes for making fibrous, non-woven articles can be employed herein.

In still another mode, the bags can be manufactured from porous paper in which holes can optionally be punched to provide vapor release during the present process.

Overall Process—While the compositions and process of the present invention can be employed under any circumstances where stain removal from a fabric is desired, such as a spot removal step in a conventional aqueous laundering process as noted above, they are especially useful in a home dry cleaning and/or fabric refreshment process, as is described in more detail hereinafter.

As shown in FIG. 1, a portion of the cleaning composition is directed onto the stained area of the fabric from a bottle. The fabric is preferably underlayed with 1–5 thicknesses of BOUNTY® brand paper toweling. The protuberances on the cleaning device are brought into close contact with the stain, e.g., by rocking or rolling the device on the stain, typically using hand pressure. Side-to-side rubbing with the device is preferably avoided to minimize potential fiber damage. Contact is maintained for a period of 1–10 seconds for lighter stains and 1–5 minutes, or longer, for heavier or more persistent stains. After the stains are loosened in the described manner, the loosened stain matter and excess cleaning composition are optionally removed by gentle padding with a towel or tissue.

The second step of the overall process is conveniently conducted in a tumbling apparatus, preferably in the presence of heat. In one convenient mode a nylon container bag with the carrier/aqueous cleaning and/or refreshment composition and enveloping the pre-spotted fabric being cleaned and refreshed is sealed and placed in the drum of an automatic hot air clothes dryer at temperatures of 40° C.–150° C. The drum is allowed to revolve, which imparts a tumbling action to the bag and agitation of its contents concurrently with the tumbling. By virtue of this agitation, the fabrics come in contact with the carrier containing the composition. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user.

The following examples illustrate the present invention in more detail, but are not intended to be limiting thereof.

EXAMPLE I

A liquid cleaning/pre-spotting composition is formulated by admixing the following ingredients.

| Ingredient | % (wt.) |
|---|---|
| BPP | 4.0 |
| $C_{12}$–$C_{14}$ AS, Na salt | 0.25 |
| Water and minors* | Balance |

*Includes preservatives such as KATHON ® at levels of 0.00001%–1%, by weight.

The fabric to be treated is laid flat and 0.5 ml–4 ml of the composition is applied directly to the stain and worked in using the cleaning device.

Other useful compositions which can be used in this step are as follows:

| Ingredient | Percent (wt.) | (Range, wt.) |
|---|---|---|
| BPP | 4.0 | 0.1–4.0% |
| $C_{12}$–$C_{14}$ AS | 0.4 | 0.1–0.5% |
| Nonionic Surfactant (optional)* | 0.1 | 0–0.5% |

-continued

| Ingredient | Percent (wt.) | (Range, wt.) |
|---|---|---|
| Water (distilled or deionized) Target pH = 7.0 | Balance | 95–99.8% |

*The optional nonionic surfactants in the compositions herein are preferably $C_{12}$–$C_{14}$ N-methyl glucamides or ethoxylated $C_{12}$–$C_{16}$ alcohols (EO 1–10).

The pre-spotted fabric is then placed in a flexible bag (most preferably prepared from 1–3 mil nylon film) together with a sheet containing a cleaning/refreshment composition according to Example III. The bag is closed and sealed using a Velcro®-type fastener. Other fasteners such as nylon zipper and Zip-Lok®-type fasteners may also be used. In a typical mode, the bag will have a volume of about 25,000 $cm^3$, which will accommodate up to about 2 kg of dry fabrics. When the fabrics and the cleaning sheet are placed in the bag, the air is preferably not squeezed out of the bag before closing and sealing. This allows the bag to billow, thereby providing sufficient space for the fabrics and cleaning sheet to tumble freely together. The bag is then closed, sealed and placed in a conventional hot-air clothes dryer. The dryer is started and the bag is tumbled for a period of 20–30 minutes at a dryer air temperature in the range from about 40° C. to about 150° C. During this time, the sheet comes into close contact with the fabrics. After the machine cycle is complete, the bag and its contents are removed from the dryer, and the spent cleaning sheet is discarded. The nylon bag is retained for re-use. The fabrics are cleaned and refreshed. The water present in the composition serves to minimize wrinkles in the fabrics. Excellent overall cleaning and refreshment is secured when from about 3 g to about 50 g of the preferred compositions herein are used per kilogram of fabric being cleaned.

EXAMPLE II

In a preferred mode, the containment bag of Example I is provided with a series of holes or vents to provide controlled release of vapors in the hot air clothes dryer, thereby minimizing wrinkling and maximizing malodor removal. Typically, 6 pairs of 2 mm diameter venting holes are punched in a 25000 $cm^3$ nylon bag and used herein. The amount of venting can be varied, e.g., from 6 pairs of 2 mm holes for 1X (23 g) usage of the water-based composition up to 15 pairs of 6 mm holes for 3X composition usage.

EXAMPLE III

A fabric refreshment product is prepared, as follows.

| Ingredient | % (wt.) |
|---|---|
| Water | 99.3 |
| Emulsifier (TWEEN 20)* | 0.3 |
| Perfume | 0.4 |

*Polyoxyethylene (20) sorbitan monolaurate available from ICI Surfactants.

23 Grams of the fabric refreshment product are applied to a 25 cm×45 cm sheet of non-woven fabric. In simple, yet effective, mode, the carrier is placed in a pouch and saturated with the refreshment product. The capillary action of the substrate and, optionally, manipulation and/or laying the pouch on its side, causes the product to wick throughout the sheet. Preferably, the sheet is of a type, size and absorbency that is not "dripping" wet from the liquid refreshment product.

A multi-use portion of a pre-spotting composition is prepared, as follows.

| Ingredient | % (wt.) |
|---|---|
| BPP | 4.0 |
| AS | 0.25 |
| Water | Balance |

Step 1. A fabric to be cleaned and refreshed is selected. Localized stained areas of the fabric are treated by directly applying about 0.5–5 mls (depending on the size of the stain) of the pre-spotting composition, which is gently worked into the fabric using the device herein. The treated stains are padded with dry paper toweling. In an alternate mode, the pre-spotting composition is releasably absorbed on a carrier sheet and applied to the stains.

Step 2. Following the pre-spotting step, the fabric is placed into a perforated nylon bag (as disclosed above) or, less preferably, a vapor impermeable bag, together with the sheet releasably containing the BPP/AS/water composition or, preferably, the refreshment product of this Example III. The mouth of the bag is sealed, and the bag and its contents are placed in the drum of a conventional hot air clothes dryer. The dryer is operated in standard fashion for 20–60 minutes at an air temperature range of about 140–170° F. (60–70° C.). After the tumbling action of the dryer ceases, the cleaned and refreshed fabric is removed from the bag. The used sheet is discarded.

EXAMPLE IV

A garment with no visible stains, but with malodors (e.g., smoking, body odor, food odor, and the like) is treated as follows. Step 1 of Example III is eliminated. The garment is treated in the manner disclosed in Step 2 of Example III in a hot air clothes dryer using the sheet and a vapor-permeable nylon bag. The malodors are thereby removed from the garment.

The foregoing illustrates compositions of the present type using the AS surfactant. Improved cleaning performance can be achieved using MgAES and amine oxide surfactants, although possibly with some reduction in phase stability. Thus, aqueous compositions with ca. 2–3% BPP can be stabilized using MgAES surfactants. However, for compositions containing 4%, and higher, BPP, the formulator may wish to include AS surfactant. The amount and blend of surfactants will depend on the degree of temperature-dependent phase stability desired by the formulator. The following illustrates MgAES and mixed MgAES/AS compositions, with optional amine oxide surfactants, useful herein.

| Ingredient | Amount (wt. %) | Range (wt. %) |
|---|---|---|
| BPP | 2.0 | 0.5–3.0 |
| $MgAE_1S$ | 0.25 | 0.01–0.8 |
| $MgAE_{6.5}S$ | 0.25 | 0.01–0.8 |
| $C_{12}$ dimethyl amine oxide | 0.15 | 0–2 |
| Water | Balance | |

EXAMPLE VI

| Ingredient | Amount (wt. %) | Range (wt. %) |
|---|---|---|
| BPP | 4 | 0.5–5 |
| $MgAE_1S$ | 0.15 | 0.01–0.8 |
| $MgAE_2S$ | 0.15 | 0.01–0.8 |
| AS | 0.25 | 0.1–0.5 |
| $C_{12}$ alkyl dimethyl amine oxide | 0 | 0–2.0 |
| Water | Balance | |

The foregoing compositions are used in the manner disclosed herein in an overall fabric cleaning/refreshment process. Excellent performance is secured even without resort to other ingredients such as the relatively expensive 1,2-octanediol.

What is claimed is:

1. A phase-stable liquid refreshment and cleaning composition, comprising:

(a) butoxy propoxy propanol or other alkoxylated alkoxy propanol solvent;

(b) water;

(c) optionally, a minor amount of nonionic surfactant; and (d) an effective, phase stabilizing amount of a member selected from the group consisting of alkyl sulfate surfactant, alkyl ethoxy sulfate surfactant, and mixtures thereof.

2. A composition according to claim 1 which comprises up to about 4%, by weight, of butoxy propoxy propanol and up to about 2%, by weight of alkyl sulfate surfactant.

3. A composition according to claim 2, comprising about 4%, by weight, of butoxy propoxy propanol and up to about 0.4%, by weight of alkyl sulfate.

4. A composition according to claim 1 which comprises up to about 2%, by weight, of a magnesium alkyl ethoxy sulfate surfactant, or mixtures thereof.

5. A composition according to claim 4 which additionally comprises an amine oxide surfactant.

6. A process for cleaning or refreshing fabrics by contacting said fabrics with a composition according to claim 1.

7. A process according to claim 6 which is carried out using a cleaning device.

8. A process according to claim 6 which is carried out in a hot air clothes dryer.

* * * * *